US010943542B2

(12) United States Patent
Ogata et al.

(10) Patent No.: US 10,943,542 B2
(45) Date of Patent: Mar. 9, 2021

(54) SEMICONDUCTOR DEVICE AND METHOD FOR DRIVING A DISPLAY PANEL

(71) Applicant: SYNAPTICS INCORPORATED, San Jose, CA (US)

(72) Inventors: Toshifumi Ogata, Tokyo (JP); Atsushi Maruyama, Tokyo (JP); Goro Sakamaki, Tokyo (JP)

(73) Assignee: Synaptics Incorporated, San Jose, CA (US)

( * ) Notice: Subject to any disclaimer, the term of this patent is extended or adjusted under 35 U.S.C. 154(b) by 3 days.

(21) Appl. No.: 16/564,720

(22) Filed: Sep. 9, 2019

(65) Prior Publication Data

US 2020/0082760 A1 Mar. 12, 2020

(30) Foreign Application Priority Data

Sep. 10, 2018 (JP) ..... JP2018-168834
Feb. 21, 2019 (JP) ..... JP2019-029883

(51) Int. Cl.
*G09G 3/3258* (2016.01)
*G09G 3/20* (2006.01)

(52) U.S. Cl.
CPC ..... *G09G 3/3258* (2013.01); *G09G 3/2096* (2013.01); *G09G 2310/08* (2013.01); *G09G 2320/0626* (2013.01)

(58) Field of Classification Search
None
See application file for complete search history.

(56) References Cited

U.S. PATENT DOCUMENTS

2017/0249901 A1* 8/2017 Nakamura ..... G09G 3/3266
2018/0277034 A1* 9/2018 Kim ..... G09G 3/3225
2018/0315379 A1* 11/2018 Du ..... G09G 5/12

* cited by examiner

*Primary Examiner* — Duane N Taylor, Jr.
(74) *Attorney, Agent, or Firm* — Ferguson Braswell Fraser Kubasta PC

(57) ABSTRACT

A semiconductor device comprises circuitry and a timing generator. The circuitry is configured to generate an emission control signal that controls light emission of pixels of a display panel such that a first vertical sync period comprises a plurality of control cycles for the light emission of the pixels. The timing generator is configured to, when a length of the first vertical sync period is changed, start a next vertical sync period following the first vertical sync period at timing based on a length of the control cycles.

23 Claims, 13 Drawing Sheets

SEMICONDUCTOR DEVICE AND METHOD FOR DRIVING A DISPLAY PANEL

CROSS REFERENCE

This application claims priority to Japanese Patent Application No. 2018-168834, filed on Sep. 10, 2018, and Japanese Patent Application No. 2019-029883, filed on Feb. 21, 2019, the disclosures of which are incorporated herein by reference in their entireties.

BACKGROUND

Field

This disclosure relates to a technology for driving a display panel.

Description of the Related Art

Example display panels include a liquid crystal display (LCD) panel and an organic light emitting diode (OLED) display panel. The brightness level of an image displayed on a self-luminous display panel, such as an OLED display panel, can be controlled by adjusting the ratio of light producing pixels to total pixels at each moment. Further, the brightness level of the displayed image increases as the ratio of the light producing pixels increases, and vice versa.

SUMMARY

In one or more embodiments, a semiconductor device comprises circuitry configured to generate an emission control signal that controls light emission of pixels of a display panel such that a first vertical sync period comprises a plurality of control cycles for the light emission of the pixels. The semiconductor device further comprises a timing generator configured to, when a length of the first vertical sync period is changed, start a next vertical sync period following the first vertical sync period at timing based on a length of the control cycles.

In one or more embodiments, a semiconductor device comprises circuitry configured to generate an emission control signal that controls light emission of pixels of a display panel such that a first vertical sync period of a plurality of vertical sync periods comprises a plurality of control cycles for the light emission of the pixels. The semiconductor device further comprises a data interface configured to transmit an image data transmission request to a host in the first vertical sync period. Further, the semiconductor device comprises a timing generator configured to generate a vertical sync signal defining the plurality of vertical sync periods and, when the data interface does not start receiving image data within a predetermined period after the transmission of the image data transmission request, delay timing at which the vertical sync signal is next asserted, based on a length of the control cycles.

In one or more embodiments, a display panel driving method comprises supplying to a display panel an emission control signal controlling light emission of pixels of the display panel to dispose a plurality of control cycles of the light emission of the pixels are disposed in a first vertical sync period, and when a length of the first vertical sync period is changed, starting a next vertical sync period following the first vertical sync period at timing based on a length of the control cycles.

BRIEF DESCRIPTION OF THE DRAWINGS

So that the manner in which the above recited features of the present disclosure may be understood in detail, a more particular description of the disclosure, briefly summarized above, may be had by reference to embodiments, some of which are illustrated in the appended drawings. It is to be noted, however, that the appended drawings illustrate only some embodiments of this disclosure and are therefore not to be considered limiting of its scope, for the disclosure may admit to other equally effective embodiments.

DETAILED DESCRIPTION

Figure 1A:
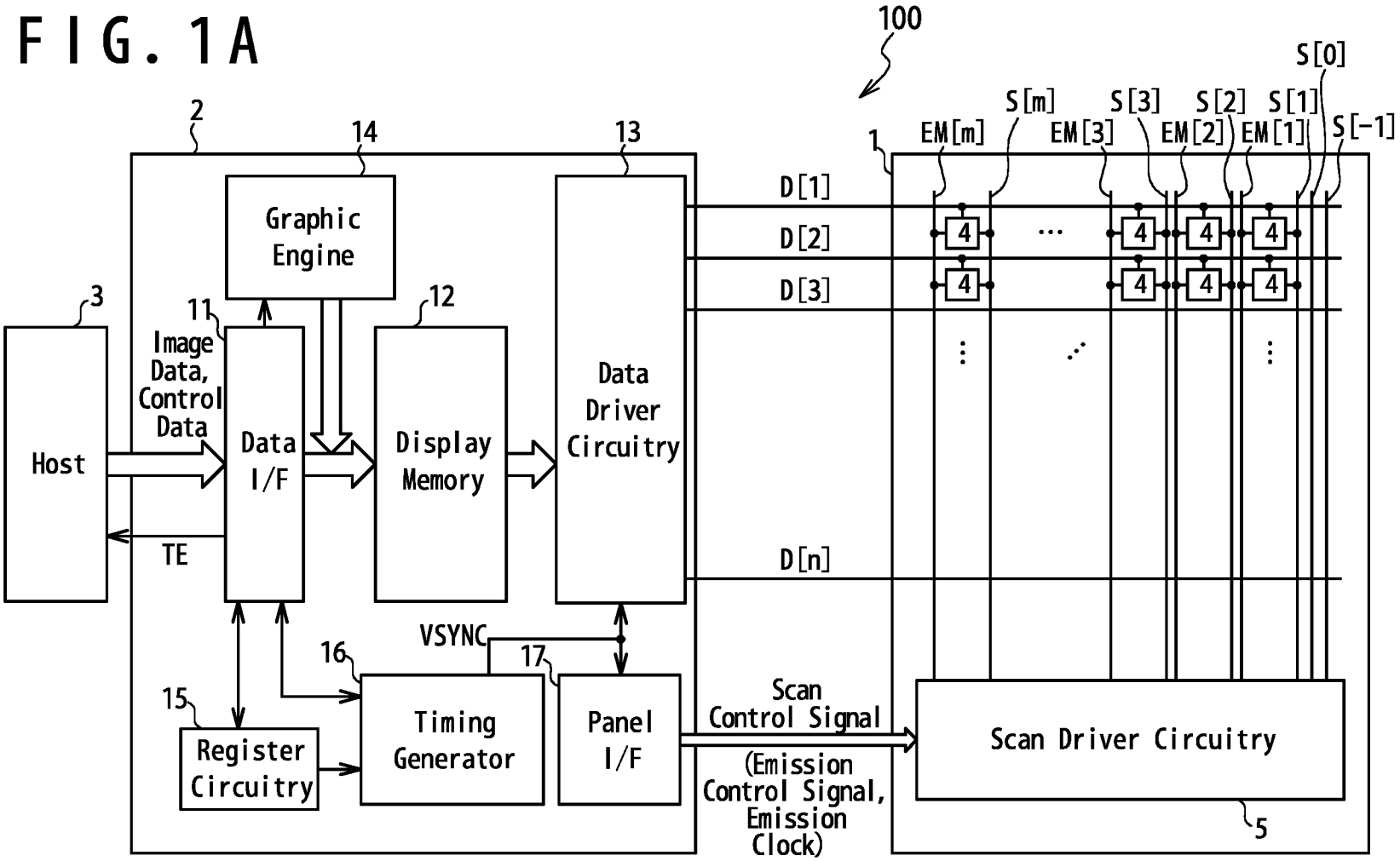
FIG. 1A is a block diagram illustrating one example configuration of a display panel, according to one or more embodiments.

In one or more embodiments, as illustrated in FIG. 1A, a display device 100 comprises a display panel 1 and a display driver 2. A self-luminous display panel such as an OLED display panel may be used as the display panel 1. In one or more embodiments, the display device 100 is configured to display an image corresponding to image data received from a host 3.

In one or more embodiments, the display panel 1 comprises pixels 4 arrayed in a matrix, scan lines S[-1] to S[m], emission lines EM[1] to EM[m], data lines D[1] to D[n], and scan driver circuitry 5. In one or more embodiments, each pixel 4 is configured to emit light with a brightness level corresponding to a specified grayscale value.

Figure 1B:
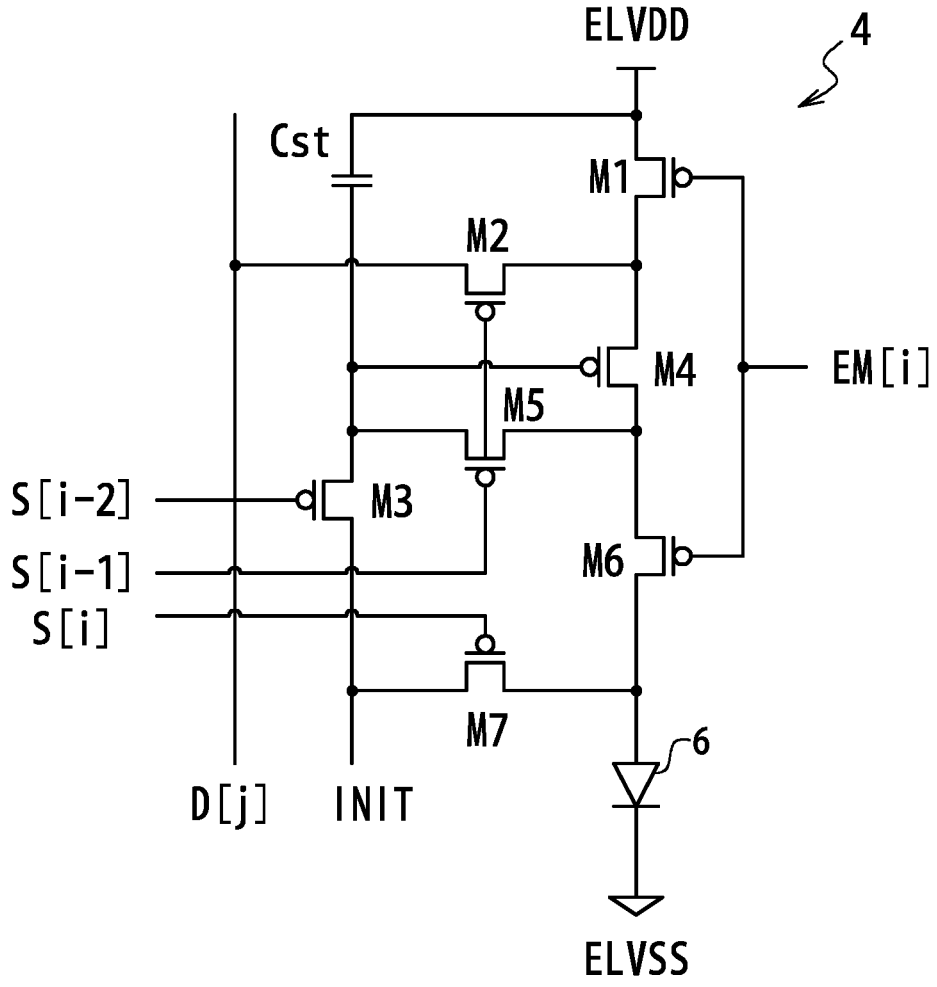
FIG. 1B is a circuit diagram illustrating an example configuration of a pixel, according to one or more embodiments.

In one or more embodiments, as illustrated in FIG. 1B, each pixel 4 has a so-called 7T1C configuration and comprises PMOS transistors M1 to M7, a hold capacitor Cst, and a light emitting element 6. When an OLED display panel is used as the display panel 1, an OLED element is used as the light emitting element 6, in one or more embodiments. Illustrated in FIG. 1B is the configuration of the pixel 4 connected to the emission line EM[i] and the data line D[j]. In one or more embodiments, other pixels 4 are similarly configured.

In one or more embodiments, when a write operation is performed to program a drive voltage corresponding to a grayscale value into the pixel 4, the emission line EM[i] is deasserted, and the scan lines S[i-2], S[i-1] and S[i] are operated in a predetermined sequence with the data line D[j] supplied with the drive voltage, to write the drive voltage into the hold capacitor Cst. In one or more embodiments, the hold capacitor Cst is configured to hold a hold voltage corresponding to the drive voltage written into the pixel 4. In one or more embodiments, when the emission line EM[i] is deasserted, the PMOS transistors M1 and M6 are turned off and the light emitting element 6 stops emitting light. In one or more embodiments, when the emission line EM[i] is asserted after the write operation is completed, the PMOS transistors M1 and M6 are turned on and the light emitting element 6 emits light with the brightness level corresponding to the hold voltage held across the hold capacitor Cst. The pixels 4 may adopt various configurations other than that illustrated in FIG. 1B such as a 5T2C configuration and a 6T1C configuration.

Referring back to FIG. 1A, the scan driver circuitry 5 is configured to drive the scan lines S[-1] to S[m] and the emission lines EM[1] to EM[m] to select a "row" (in the vertical direction in FIG. 1A) of the pixels 4 for which a write operation is to be performed, in one or more embodiments. In one or more embodiments, each row of pixels 4 comprises an array of pixels 4 arrayed in one line in the direction parallel to the scan lines S[-1] to S[m] and the emission lines EM[1] to EM[m]. In one or more embodiments, the scan driver circuitry 5 is configured to deassert the emission line EM[i] and operate the scan lines S[i-2], S[i-1] and S[i] in a predetermined sequence when a write operation is performed for pixels 4 in the $i^{th}$ row.

In one or more embodiments, the scan driver circuitry 5 is further configured to control light emission from rows of pixels 4 for which a write operation is not being performed, based on an emission control signal received from the display driver 2. In one or more embodiments, the emission control signal controls light emission of pixels 4. In one or more embodiments, an emission clock is supplied from the display driver 2 to the scan driver circuitry 5, and permission and prohibition of light emission from pixels 4 of each row are controlled in synchronization with the emission clock. In one or more embodiment, the emission line EM corresponding to the row of pixels 4 for which the write operation is being performed is deasserted to prohibit light emission of pixels 4 of this row.

In one or more embodiments, the display driver 2 is configured as a semiconductor device which comprises a data interface 11, a display memory 12, data driver circuitry 13, a graphic engine 14, register circuitry 15, a timing generator 16, and a panel interface 17.

In one or more embodiments, the data interface 11 is configured to communicate with the host 3 to exchange with the host 3 various data used for control of the display driver 2. In one or more embodiments, the data interface 11 is configured to receive image data and control data. In one or more embodiments, the image data comprise commands for controlling the operation of the graphic engine 14 and/or grayscale data to be written into the display memory 12, the grayscale data describing grayscale values of the respective pixels 4. In one or more embodiments, the control data is used for control of the operation of the display driver 2. In one or more embodiments, the data interface 11 is further configured to interpret commands included in the image data and control data and forward the commands to desired destinations, including the graphic engine 14 and the register circuitry 15. In one or more embodiments, the data interface 11 is further configured to transmit control packets to the host 3 under the control of the timing generator 16. In one or more embodiments, the data interface 11 is configured to transmit to the host 3 a tearing effect (TE) packet which requests transmission of image data, under the control of the timing generator 16.

In one or more embodiments, the display memory 12 is configured to store grayscale data specifying grayscale values of the respective pixels 4.

In one or more embodiments, the data driver circuitry 13 is configured to generate drive voltages corresponding to the grayscale values specified in the grayscale data received from the display memory 12 and write the drive voltages into the respective pixels 4 via the data lines D[1] to D[n].

In one or more embodiments, the graphic engine 14 is configured to receive commands included in the image data received from the host 3 and update the grayscale data stored in the display memory 12 based on the commands.

In one or more embodiments, the register circuitry 15 is configured to store various register values used for the control of the operation of the display driver 2. When a control data transmitted from the host 3 to the display driver 2 comprises a register value, the register value may be stored in the register circuitry 15, in one or more embodiments.

In one or more embodiments, the timing generator 16 is configured to perform timing control of the display driver 2. In one or more embodiments, the timing generator 16 is configured to generate an internal vertical sync signal VSYNC used in the display driver 2. In one or more embodiments, vertical sync periods in the display driver 2 are defined by the internal vertical sync signal VSYNC, and various timing controls in the display driver 2 are performed using the internal vertical sync signal VSYNC as a timing reference.

In one or more embodiments, the panel interface 17 is configured to generate scan control signals to control the scan driver circuitry 5. In one or more embodiments, the scan control signals include the above-described emission control signal, and the scan driver circuitry 5 is configured to control light emission of the pixels 4 based on the emission control signal. In one or more embodiments, the scan control signals include the above-described emission control signal and emission clock, and the scan driver circuitry 5 is configured to control light emission of the pixels 4 based on the emission control signal and the emission clock.

Figure 2:
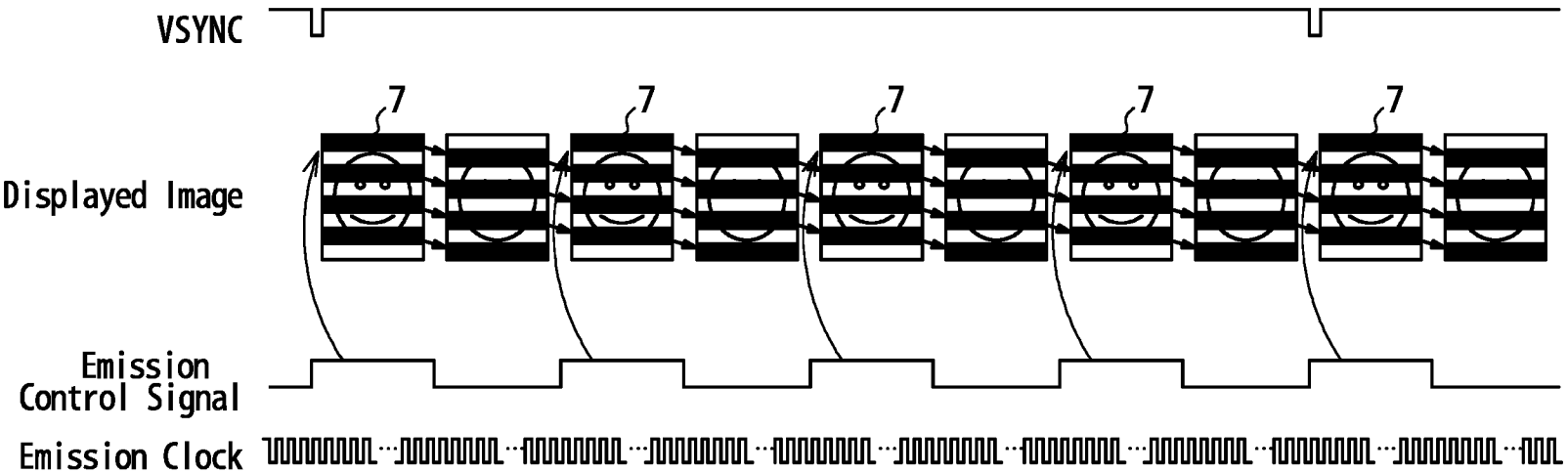
FIG. 2 is a timing chart illustrating one example operation of the display device, according to one or more embodiments.

In one or more embodiments, as illustrated in FIG. 2, the scan driver circuitry 5 is configured to control light emission of pixels 4 of the respective rows based on the emission control signal in synchronization with the emission clock. It should be noted that, in FIG. 2, the direction of the display panel is rotated from that in FIG. 1A by 90 degrees: the horizontal direction is the direction of the rows of the pixels, that is, the direction along the scan lines S[-1] to S[m] and the emission lines EM[1] to EM[m]; and the vertical direction is the direction along the data lines D[1] to D[n].

In one or more embodiments, control of light emission of the pixels 4 is performed with a constant periodicity. In one or more embodiments, the emission control signal is used for permission and prohibition of light emission of the pixels 4 of the respective rows. In one or more embodiments, the emission control signal is asserted and deasserted with a constant periodicity. In the following, the cycle to control the light emission of the pixels 4 may be referred to as "control cycle". In one or more embodiments, the control cycle may be a cycle to assert and deassert the emission control signal. In one or more embodiments, the length of the control cycles is constant and equal to the periodicity of the emission control signal. In one or more embodiments, as illustrated in FIG. 2, four control cycles are disposed in one vertical sync period. In one or more embodiments, emission pulses appear on the emission control signal due to repeated assertions and deassertions of the emission control signal. In one or more embodiments, one vertical sync period comprises four control cycles, and the emission control signal comprises four emission pulses per vertical sync period.

In one or more embodiments, a non-light emitting area 7 in which pixels 4 do not emit light is inserted at an edge of the display panel 1 based on the emission control signal. In one or more embodiments, a non-light emitting area 7 is inserted at the edge of the display panel 1 while the emission control signal is deasserted. In FIG. 2, the emission control signal is illustrated as a low-active signal. In one or more embodiments, a non-light emitting area 7 is inserted at the edge of the display panel 1 by deasserting a predetermined number of emission lines at the edge of the display panel 1 while the emission control signal is deasserted. In one or more embodiments, a non-light emitting area 7 is not inserted while the emission control signal is being asserted, and the pixels 4 of the row at the edge of the display panel 1 emit lights.

In one or more embodiments, non-light emitting areas 7 are moved in the direction along the data lines D[1] to D[n] in synchronization with the emission clock. In one or more embodiments, the non-light emitting areas 7 are moved by shifting the deasserted emission lines EM in the direction along the data lines D[1] to D[n] in synchronization with the emission clock.

In one or more embodiments, when the period of time in which the emission control signal is deasserted is prolonged, the period of time in which a non-light emitting area 7 is inserted is also prolonged, and this enlarges the width of the inserted non-light emitting area 7 in the direction along the data lines D[1] to D[n].

In one or more embodiments, the display brightness level of the display panel 1, that is, the brightness level of the entire image displayed on the display panel 1 is controlled by controlling the width of the non-light emitting areas 7 in the direction along the data lines D[1] to D[n]. In one or more embodiments, the display brightness level of the display panel 1 decreases when the ratio of the non-light emitting areas 7 to the entire display area of the display panel 1 increases, wherein the display area is the area in which the pixels 4 are arrayed. In one or more embodiments, when the width of the non-light emitting areas 7 is maximized, none of the pixels 4 emit light and the display brightness level of the display panel 1 becomes the lowest brightness level. In one or more embodiments, the display brightness level of the display panel 1 increases as the ratio of the non-light emitting areas 7 decreases. In one or more embodiments, when the width of the non-light emitting areas 7 is minimized, the display brightness level of the display panel 1 becomes the highest brightest level.

In one or more embodiments, the display brightness level of the display panel 1 is controlled by controlling the ratio of the period during which the emission control signal is asserted to the entire period of each control cycle. In one or more embodiments, when the ratio of the period during which the emission control signal is deasserted is increased in each control cycle, the widths of the non-light emitting areas 7 increase and the display brightness level decreases. In one or more embodiments, when the ratio of the period during which the emission control signal is asserted is increased in each control cycle, the widths of the non-light emitting areas 7 decrease and the display brightness level increases.

Figure 3:
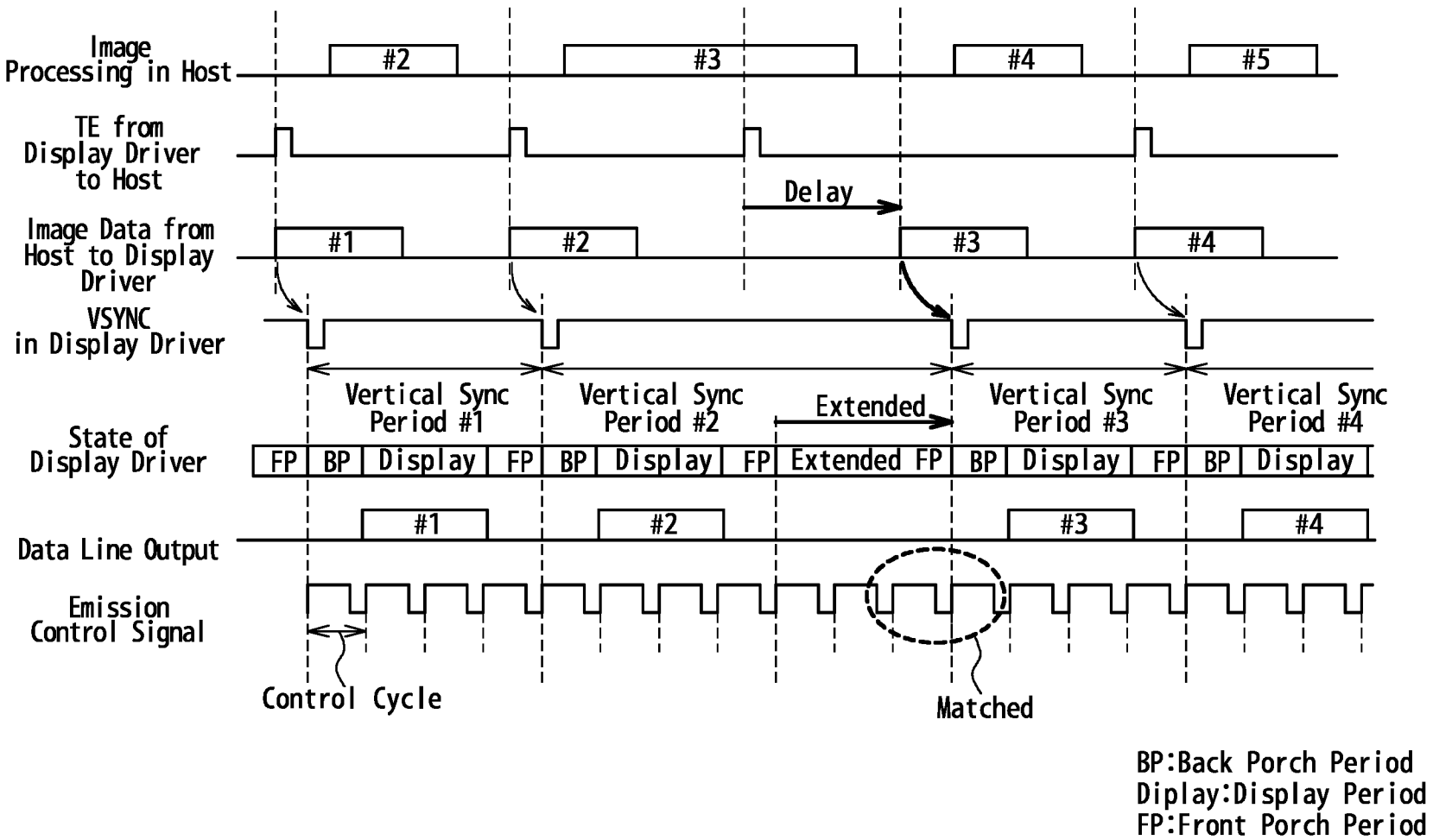
FIG. 3 is a timing chart illustrating one example operation of the display device, according to one or more embodiments.

In one or more embodiments, the display device 100 operates as illustrated in FIG. 3. In one or more embodiments, the host 3 has already completed generation of image data #1 corresponding to an image to be displayed on the display panel 1 in vertical sync period #1 in an initial state.

In one or more embodiments, the display driver 2 transmits a request for image data transmission to the host 3 once the display driver 2 is ready to receive image data. The request may be a TE packet. Once the host receives the request, the host 3 may start transmitting image data #1, and the data interface 11 of the display driver 2 may start receiving image data #1.

In one or more embodiments, the timing generator 16 asserts the internal vertical sync signal VSYNC upon the start of the reception of image data #1. In one or more embodiments, the assertion of the internal vertical sync signal VSYNC initiates vertical sync period #1 in the display driver 2. In one or more embodiments, image data #1 transmitted from the host 3 to the display driver 2 may contain a predetermined command. In this case, the data interface 11 of the display driver 2 may detect the start of the reception of image data #1 from the host 3 based on the predetermined command. The predetermined command may be disposed at the head of the image data #1.

In one or more embodiments, vertical sync period #1 comprises a back porch period, a display period following the back porch period, and a front porch period following the display period. In one or more embodiments, preparation for writing drive voltages into the respective pixels 4 during the display period is performed in the back porch period. In one or more embodiments, the drive voltages are written into the respective pixels 4 during the display period. In one or more embodiments, the scan driver circuitry 5 sequentially selects the rows of the pixels 4 during the display period, and the data driver circuitry 13 writes the drive voltages into the pixels 4 of the selected row via the data lines D[1] to D[n], the drive voltages corresponding to the grayscale values specified for the pixels 4 of the selected row. In one or more embodiments, preparation of the operation for in the next vertical sync period #2 is performed in the front porch period.

In one or more embodiments, light emission of the pixels 4 of the display panel 1 is controlled on the emission control signal. In one or more embodiments, assertion and deassertion of the emission lines EM[1] to EM[m] are controlled based on the emission control signal and the emission clock. In one or more embodiments, rows of pixels 4, for which the write operation is not performed, emit light when the corresponding emission lines EM are asserted and do not emit light when the corresponding emission lines EM are deasserted. Illustrated in FIG. 3 is the waveform of the emission control signal for the case where the emission control signal is a low-active signal. The low-active signal is set to the low level when the emission lines are asserted. Rows of pixels 4, for which the write operation is performed, do not emit light regardless of the state of the emission control signal.

In one or more embodiments, as illustrated in FIG. 3, a plurality of control cycles are disposed in each vertical sync period. In one or more embodiments, each vertical sync period comprises four control cycles by default. In one or more embodiments, the "default" is the case where the vertical sync period is not extended. In one or more embodiments, the vertical sync period length may be changed or extended as described later. In one or more embodiments, the default length of a vertical sync period is an integer multiple of the length of the control cycles. In the operation illustrated in FIG. 3, the default length is four times of the length of the control cycles.

In one or more embodiments, the host 3 performs image processing to generate image data #2 corresponding to an image to be displayed in vertical sync period #2 in the meantime.

In one or more embodiments, when the display driver 2 is ready to receive image #2 from the host 3 after a predetermined period of time has elapsed after the start of vertical sync period #1, the display driver 2 transmits a TE packet to the host 3. In one or more embodiments, the host 3 starts transmitting image data #2 when receiving the TE packet. In one or more embodiments, this results in that the display driver 2 starts receiving image data #2.

In one or more embodiments, the timing generator 16 asserts the internal vertical sync signal VSYNC once the display driver 2 starts to receive image data #2. This initiates vertical sync period #2 in the display driver 2.

In one or more embodiments, vertical sync period #2 comprises: a back porch period for the preparation of writing drive voltages into the respective pixels; a display period for writing the drive voltages into the respective pixels 4; and a front porch period for the preparation of the operation for the next vertical sync period #3, similarly to vertical sync period #1. In one or more embodiments, light emission of the pixels 4 of the display panel 1 is controlled by the emission control signal during vertical sync period #2.

In one or more embodiments, during the display driver 2 is in vertical sync period #2, the host 3 generates image data #3 corresponding to an image to be displayed during vertical sync period #3. When the generation of image data #3 takes longer time than vertical sync period #2 and cannot be completed before receiving a next request or TE packet from the display driver 2, vertical sync period #2 may be extended.

In one or more embodiments, when the display driver 2 does not detect the start of reception of image data #3 until a predetermined period of time has elapsed after the transmission of the TE packet to the host 3, the display driver 2 changes or extends the length of vertical sync period #2 by extending the front porch period and waits for the host 3 to start transmitting image data #3. In The extended part of the front porch period is indicated as "extended FP" in FIG. 3. In one or more embodiments, the emission control signal continues to control the light emission of the pixels 4 by the emission control signal is continued in the extended FP. The extended FP may correspond to one or more control cycles of the emission control signal. In such embodiments with the extended FP, the timing at which the internal vertical sync signal VSYNC is next asserted is delayed from the default timing.

In one or more embodiments, once the generation of image data #3 is complete, the host 3 starts transmitting image data #3 to the display driver 2. At the start of the reception of image data #3, the timing generator 16 asserts the internal vertical sync signal VSYNC to initiate vertical sync period #3.

In one or more embodiments, the timing generator 16 adjusts the timing to initiate vertical sync period #3, that is, the timing at which the timing generator 16 asserts the internal vertical sync signal VSYNC, based on the length of the control cycles. In one or more embodiments, information indicative of the length of the control cycles may be stored in the register circuitry 15. For example, such information may be a register value that specifies the periodicity of the emission control signal. The timing at which vertical sync period #3 is initiated may be determined based on the stored register value.

In one or more embodiments, the timing generator 16 may synchronize the timing at which vertical sync period #3 is initiated, that is, the timing at which the internal vertical sync signal VSYNC is asserted, with the timing at which the final control cycle is completed. In some embodiments, such synchronization may be performed by making the timing of the initiation of vertical sync period #3 match or coincide with the timing of the completion of the final control cycle. In other embodiments, the timing generator 16 controls the timing of the vertical sync period #3 initiation so that the length of vertical sync period #2 becomes an integer multiple of the length of the control cycles or an integer multiple of the periodicity of the emission control signal. FIG. 3 shows the case in which the length of vertical sync period #2 is seven times of the periodicity of the emission control signal. This operation improves the image brightness control and suppresses or prevents occurrence of flicker or undesired changes in the brightness level.

If the final control cycle of vertical sync period #2 does not match or coincide with the timing of the vertical sync period #3 initiation, the final control cycle of vertical sync period #2 is not fully completed. For example, the period during which the emission control signal is being deasserted is prolonged to bridge vertical sync periods #2 and #3. This may make the user observe an instantaneous brightness decrease in the image displayed on the display panel 1. Through the operation as described above in connection with FIG. 3, the lengths of the periods during which the emission control signal is asserted and the lengths of the periods during which the emission control signal is deasserted are kept constant for the control cycles included in vertical sync period #2 even when vertical sync period #2 is extended. This effectively suppresses or prevents occurrence of the instantaneous brightness decrease.

Figure 4:
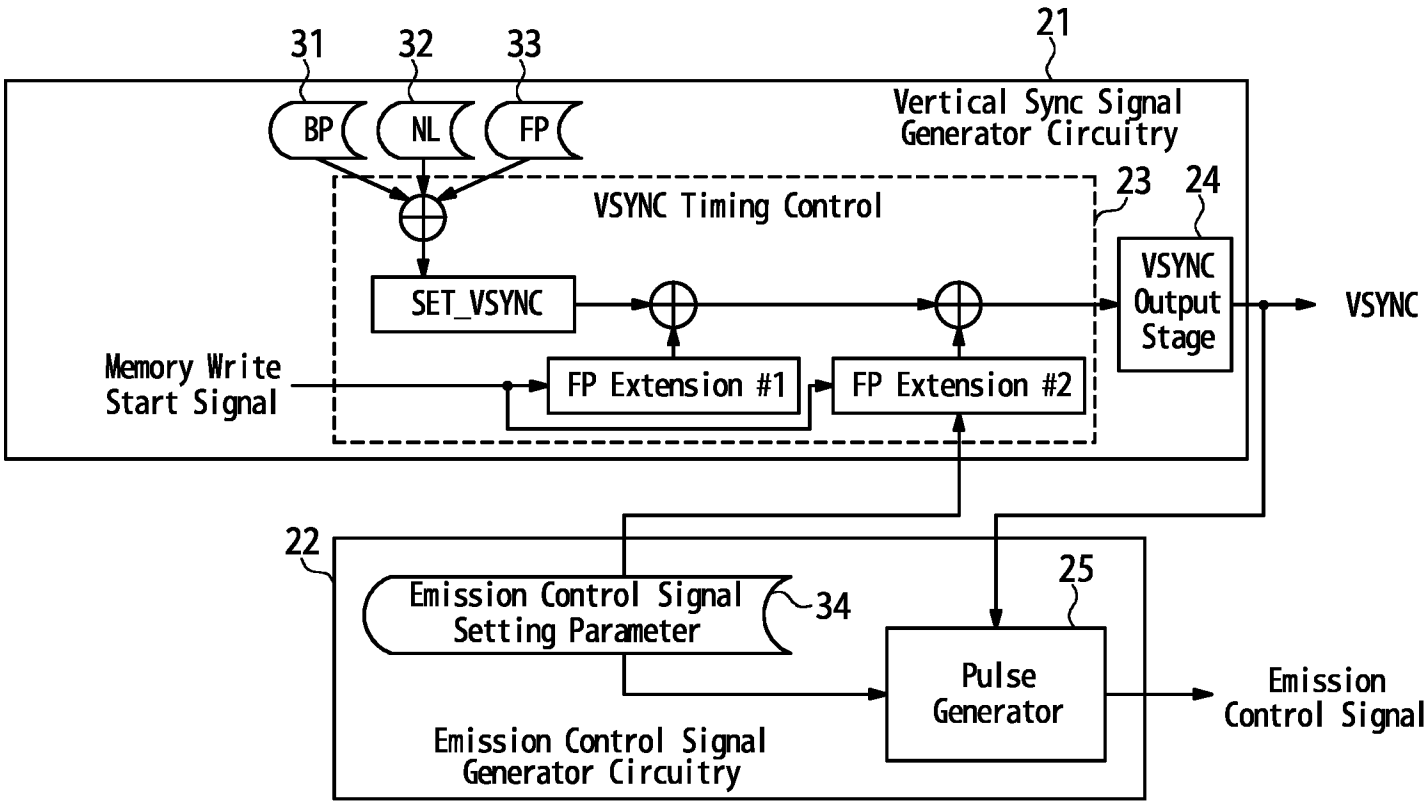
FIG. 4 is a block diagram illustrating example configurations of vertical sync signal generator circuitry and emission control signal generator circuitry, according to one or more embodiments.

In one or more embodiments, as illustrated in FIG. 4, the timing generator 16 may comprise vertical sync signal generator circuitry 21, and the panel interface 17 may comprise emission control signal generator circuitry 22. In some embodiments, the emission control signal generator circuitry 22 may be disposed outside or separate from the panel interface 17. In one or more embodiments, the vertical sync signal generator circuitry 21 and the emission control signal generator circuitry 22 are configured to achieve the operation illustrated in FIG. 3.

In one or more embodiments, the vertical sync signal generator circuitry 21 comprises: VSYNC timing control circuitry 23 configured to determine the timing at which the internal vertical sync signal VSYNC is asserted; and a vertical sync signal output stage 24 configured to output the internal vertical sync signal VSYNC and assert the internal vertical sync signal VSYNC at timing determined by the VSYNC timing control circuitry 23.

In one or more embodiments, the VSYNC timing control circuitry 23 is configured to control the timing of the assertion of the internal vertical sync signal VSYNC, based on a back porch register value 31, a display line register value 32, a front porch register value 33, and a memory write start signal, where the back porch register value 31, the display line register value 32, and the front porch register value 33 are stored in the register circuitry 15. In one or more embodiments, the back porch register value 31 specifies the length of the back porch periods and the display line register value 32 specifies the length of the display periods. In one or more embodiments, the front porch register value 33 specifies the length of the front porch periods. In one or more embodiments, the memory write start signal is asserted when the data interface 11 receives a memory write start command from the host 3. In one or more embodiments, image data transmitted from the host 3 comprises a memory write start command and this allows the VSYNC timing control circuitry 23 to detect start of reception of image data by the display driver 2 based on the memory write start signal.

In one or more embodiments, the emission control signal generator circuitry 22 comprises a pulse generator 25 configured to generate the emission control signal based on emission control signal setting parameters stored in the register circuitry 15. In one or more embodiments, the emission control signal setting parameters specify the waveform of the emission control signal, including the length of the period during which the emission control signal is asserted in each control cycle and the length of the period during which the emission control signal is deasserted in each control cycle. The emission control signal setting parameters may directly describe the length of the period during which the emission control signal is asserted and the length of the period during which the emission control signal is deasserted, or may comprise parameters from which these lengths can be calculated. In one or more embodiments, the internal vertical sync signal VSYNC is supplied to the pulse generator 25 and the operation of the pulse generator 25 is reset when the internal vertical sync signal VSYNC is asserted.

Figure 5:
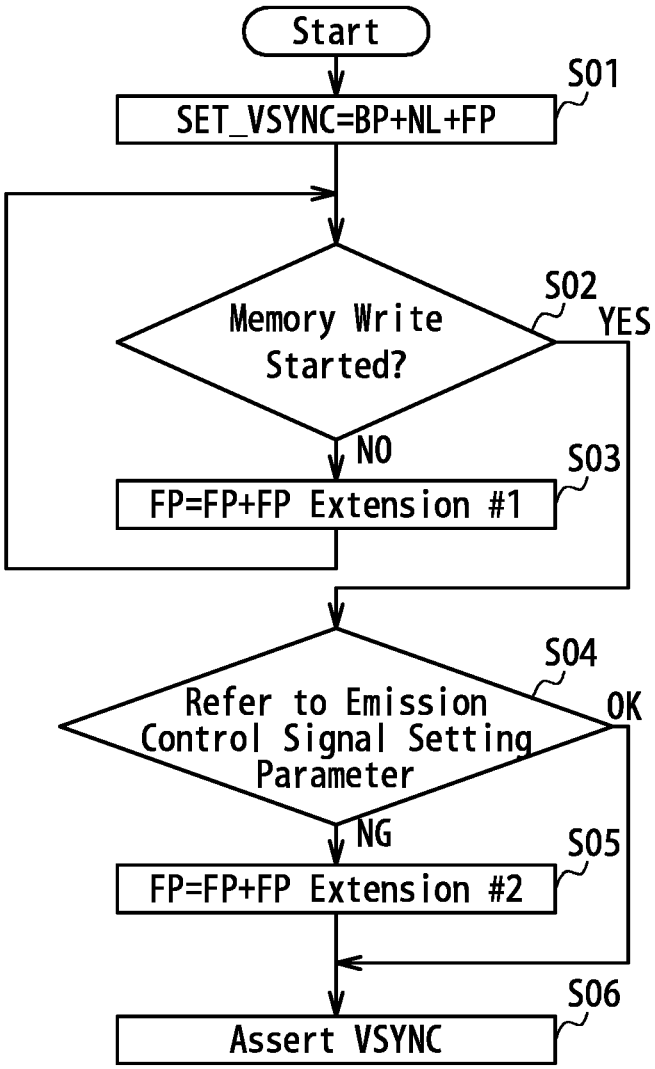
FIG. 5 is a flowchart illustrating an example operation of the vertical sync signal generator circuitry, according to one or more embodiments.

In one or more embodiments, the VSYNC timing control circuitry 23 may determine the timing of the assertion of the internal vertical sync signal VSYNC once each vertical sync period is initiated through an operation illustrated in FIG. 5.

In one or more embodiments, at step S01, the VSYNC timing control circuitry 23 calculates a parameter value SET_VSYNC that specifies the default length of the vertical sync period by adding up the back porch register value 31, the display line register value 32, and the front porch register value 33.

In one or more embodiments, at step S02, the VSYNC timing control circuitry 23 monitors the memory write start signal. In one or more embodiments, when the memory write start signal is not asserted within a predetermined period of time after a TE packet is transmitted to the host 3 in the front porch period, the VSYNC timing control circuitry 23 extends the front porch period by a predetermined extension amount #1 at step S03. In one or more embodiments, the operation to extend the front porch period by the predetermined extension amount #1 is repeated until the assertion of the memory write start signal is detected.

In one or more embodiments, when the memory write start signal is asserted, the VSYNC timing control circuitry 23 determines at step S04 whether the current vertical sync period length is appropriately determined with reference to the emission control signal setting parameters. In one or more embodiments, the length of the control cycles can be obtained from the emission control signal setting parameters, and the timing of the completion of the current vertical sync period, that is, the timing of the initiation of the next vertical sync period is adjusted based on the length of the control cycles.

In one or more embodiments, when the current vertical sync period length is determined as being appropriate, the internal vertical sync signal VSYNC is asserted upon the completion of the front porch period to initiate the next vertical sync period. In one or more embodiments, when the current vertical sync period length is determined as being an integer multiple of the length of the control cycles as a result of the extension of the front porch period at step S03, the internal vertical sync signal VSYNC is asserted at step S06 when the front porch period is completed.

In one or more embodiments, when the current vertical sync period length is not determined as being appropriate, the front porch period is further extended by an extension amount #2 at step S05. In one or more embodiments, the extension amount #2 is determined to match the length of control cycles based on the emission control signal setting parameters. In one or more embodiments, the extension amount #2 may be determined so that the current vertical sync period length becomes an integer multiple of the length of the control cycles. In one or more embodiments, the internal vertical sync signal VSYNC is asserted when the extended front porch period is completed.

Figure 6:
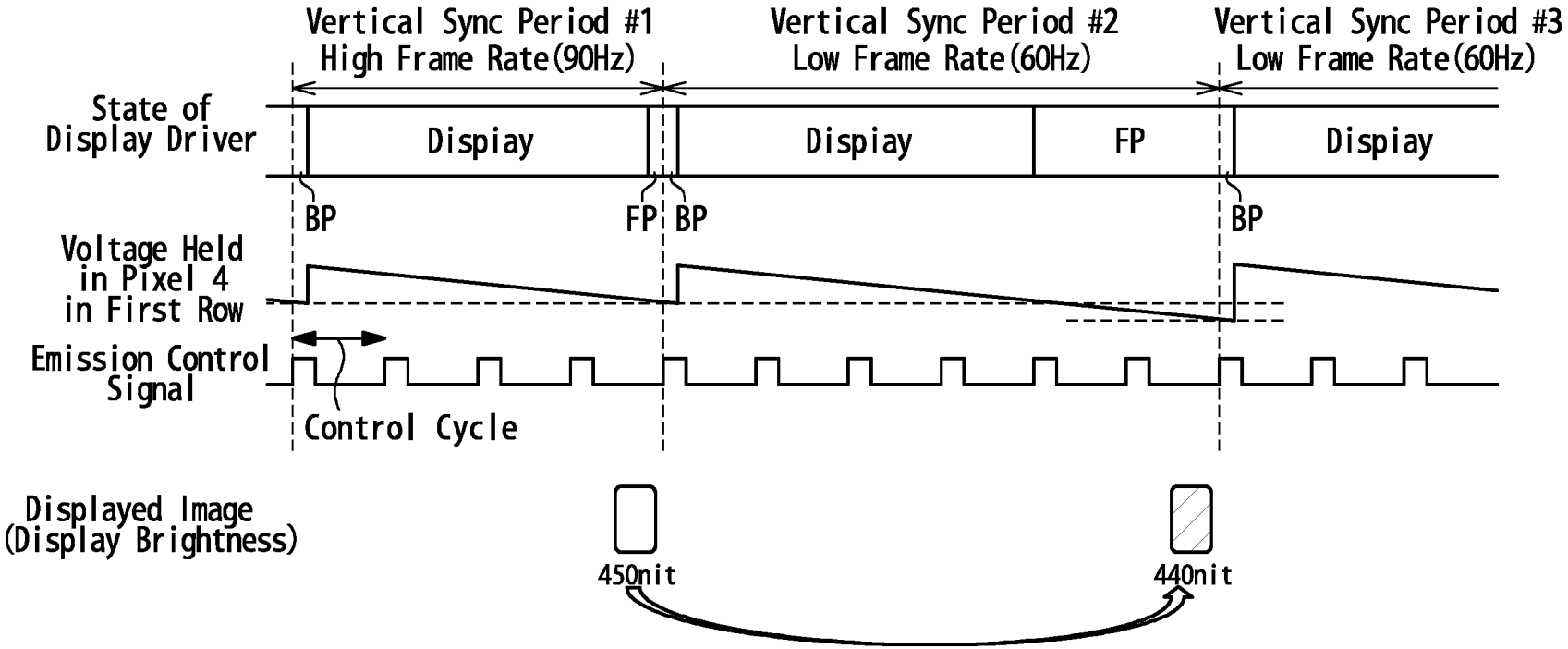
FIG. 6 is a timing chart illustrating an example operation of a display device, according to one or more embodiments.

In one or more embodiments, as illustrated in FIG. 6, the vertical sync period length is extended to switch the frame rate. In one or more embodiments, the extension of the vertical sync period length is achieved through delaying the timing at which the internal vertical sync signal SYNC is asserted by the timing generator 16. In one or more embodiments, the frame rate during vertical sync period #1 is a first frame rate, and the frame rate is switched to a second frame rate lower than the first frame rate by extending the lengths of vertical sync period #2 and the following vertical sync periods. In one or more embodiments, the frame rate is switched from the first frame rate to the second frame rate by extending front porch periods of the vertical sync periods.

In one or more embodiments, the timing of the initiation of vertical sync period #3 is synchronized with the timing of the completion of the final control cycle of vertical sync period #2. In one or more embodiments, the timing of the initiation of vertical sync period #3 is made coincident with the timing of the completion of the final control cycle of vertical sync period #2, as illustrated in FIG. 6. In one or more embodiments, the synchronization or coincidence between the timing of the vertical sync period #3 initiation and the timing of the completion of the final control cycle of vertical sync period #2 is achieved by determining the length of the control cycles based on the frame rates before and after the switching. In one or more embodiments, this improves the image brightness control and suppresses or prevents occurrence of flicker and undesired changes in the brightness level.

In one or more embodiments, such synchronization or coincidence is achieved by setting the lengths of vertical sync periods #1 and #2 to integer multiples of the length of the control cycles or by setting the length of the control cycles so that the lengths of vertical sync periods #1 and #2 are both integer multiples of the length of the control cycles. In one or more embodiments, the frame rate is 90 Hz during vertical sync period #1 and vertical sync period #1 comprises four control cycles. In such embodiments, the length of vertical sync period #1 is four times of the length of the control cycles, and the emission control signal comprises four emission pulses in vertical sync period #1. In one or more embodiments, the frame rate is switched to 60 Hz in vertical sync period #2. In such embodiments, the lengths of vertical sync period #2 and the following vertical sync periods are extended to six times of the length of the control cycles. In one or more embodiments, the timing of the completion of the final control cycle of vertical sync period #2 is made coincident with the timing of the initiation of vertical sync period #3.

In one or more embodiments, the switching of the frame rate by extending the lengths of vertical sync periods may be accompanied by variations in the display brightness level. In one or more embodiments, the variations in the display brightness level may result from leakage currents form the pixels 4. In one or more embodiments, the hold voltages held in the pixels 4 may gradually decrease after the writing of the drive voltages. Illustrated in FIG. 6 is an example hold voltage held in a pixel 4 in a row for which drive voltages are first written in each vertical sync period. In one or more embodiments, the extension of the length of vertical sync periods may cause a decrease in the display brightness level, since the drop of the hold voltages held in the pixels 4 increases as the length of vertical sync periods increases. In one or more embodiments, the display brightness level is 450 nit during vertical sync period #1 and the display brightness level is 440 nit during vertical sync period #2, which is longer than vertical sync period #1. In one or more embodiments, such variations in the display brightness level may be observed as flicker.

Figure 7:
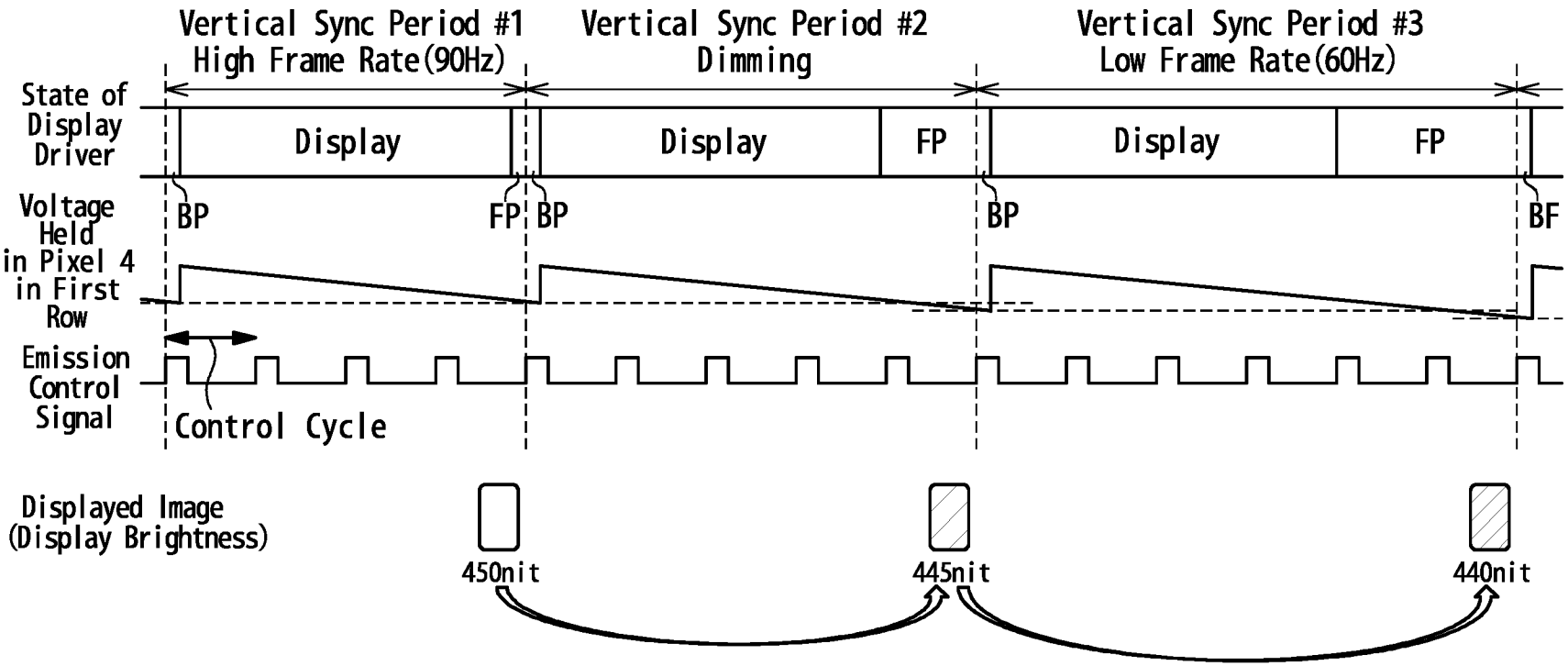
FIG. 7 is a timing chart illustrating one example operation of a display device, according to one or more embodiments.

In one or more embodiments, as illustrated in FIG. 7, dimming is performed in switching the frame rate and the vertical sync period length is gradually extended. In one or more embodiments, the frame rate during vertical sync period #1 is a first frame rate, and the frame rate during vertical sync period #3 and following vertical sync periods is set to a second frame rate lower than the first frame rate. In one or more embodiments, such frame rate switching is achieved by setting the length of vertical sync period #3 and the following vertical sync periods to be longer than the length of vertical sync period #1.

In one or more embodiments, vertical sync period #2, disposed between vertical sync periods #1 and #3, is used for dimming of the display brightness level; the length of vertical sync period #2 is set to be longer than that of vertical sync period #1 and shorter than that of vertical sync period #3. In such embodiments, the display brightness level during vertical sync period #2 becomes between the display brightness levels during vertical sync periods #1 and #3, reducing the change rate of the display brightness level. In one or more embodiments, the display brightness level is 450 nit during vertical sync period #1, 440 nit during vertical sync period #3, and 445 nit during vertical sync period #2. In one or more embodiments, occurrence of flicker is suppressed by reducing the change rate of the display brightness level.

In one or more embodiments, the timing of the initiation of vertical sync period #3 is synchronized with the timing of the completion of the final control cycle of vertical sync period #2, and the timing of the initiation of the vertical sync period following vertical sync period #3 is synchronized with the timing of the completion of the final control cycle of vertical sync period #3. In one or more embodiments, as illustrated in FIG. 7, the timing of the initiation of vertical sync period #3 is made coincident with the timing of the completion of the final control cycle of vertical sync period #2, and the timing of the initiation of the vertical sync period following vertical sync period #3 is made coincident with the timing of the completion of the final control cycle of vertical sync period #3 is completed. In one or more embodiments, such operation improves the image brightness control and suppresses or prevents occurrence of flicker and undesired changes in the brightness level.

In one or more embodiments, such synchronization or coincidence may be achieved by setting the lengths of vertical sync periods #1 to #3 to integer multiples of the length of the control cycles or by setting the length of the control cycles so that the lengths of vertical sync periods #1 to #3 are integer multiples of the length of the control cycles. In one or more embodiments, the frame rate is 90 Hz during vertical sync period #1 and 60 Hz during vertical sync period #3 and the following vertical sync periods. In one or more embodiments, the length of vertical sync period #1 is four times of the length of the control cycles, the length of vertical sync period #3 and the following vertical sync periods is six times of the length of the control cycles, and the length of vertical sync period #2 is five times of the length of the control cycles. In one or more embodiments, this operation can be achieved by appropriately determining the length of the control cycles.

Figure 8:
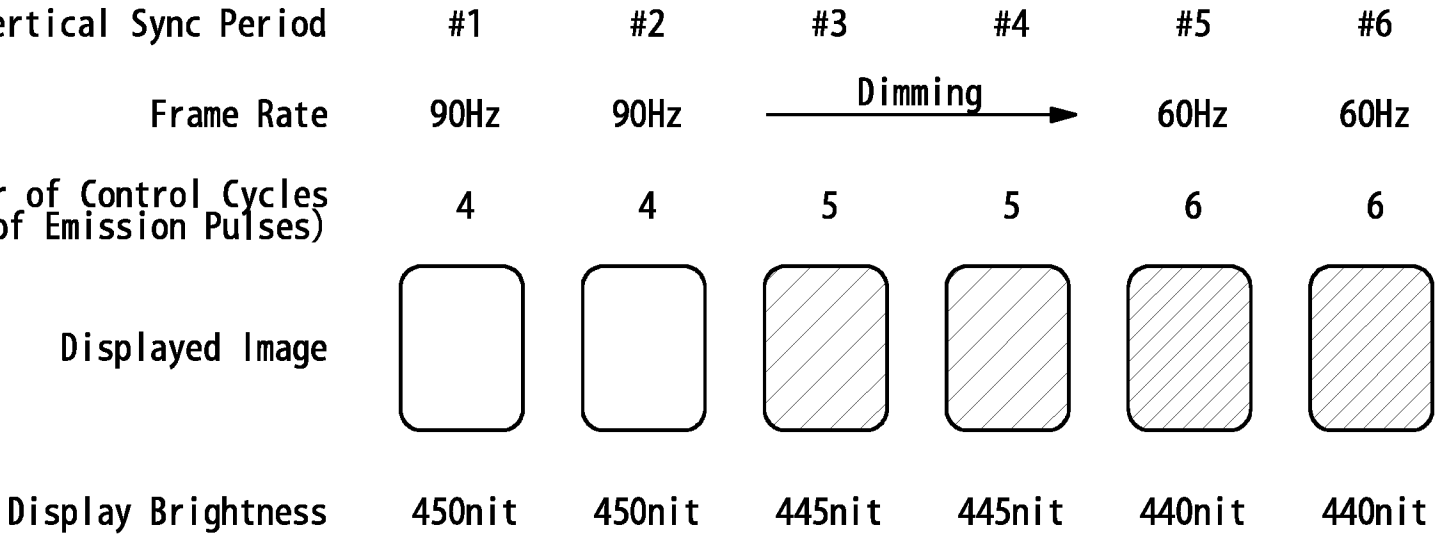
FIG. 8 illustrates an example operation of a display device, according to one or more embodiments.
Figure 9:
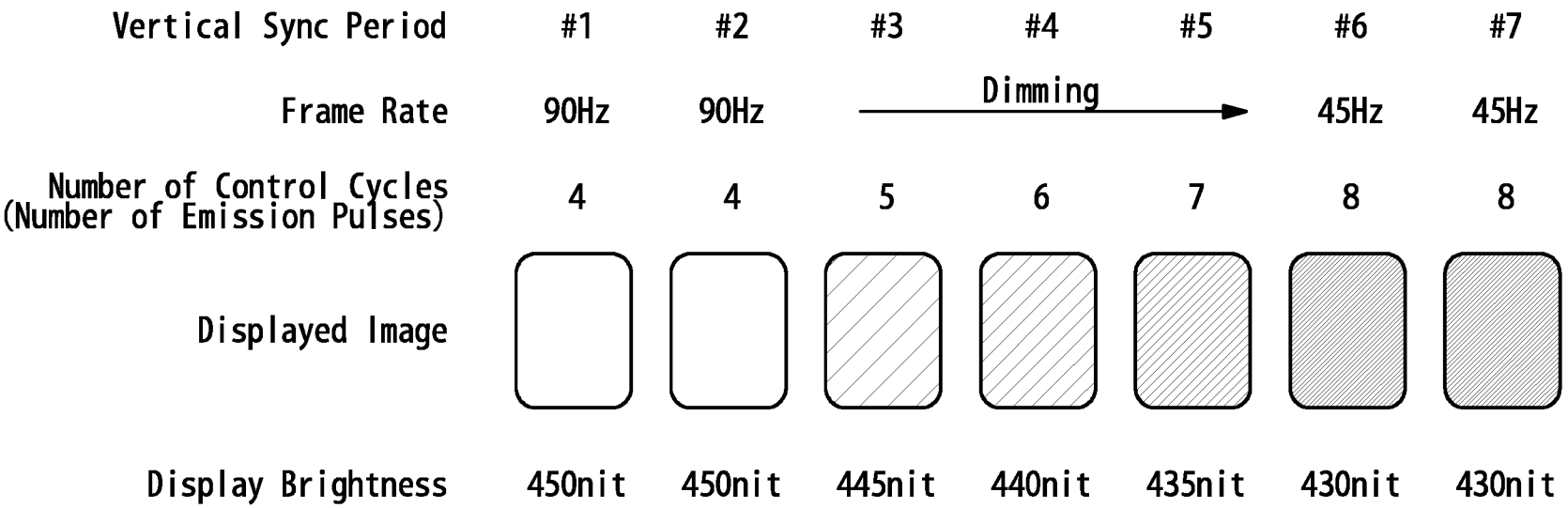
FIG. 9 illustrates an example operation of a display device, according to one or more embodiments.

In one or more embodiments, as illustrated in FIGS. 8 and 9, multiple vertical sync periods are used for dimming in switching the frame rate. In one or more embodiments, as illustrated in FIG. 8, the frame rate is set to 90 Hz during vertical sync periods #1 and #2 and 60 Hz during vertical sync periods #5, #6, and their following vertical sync periods. In one or more embodiments, vertical sync periods #3 and #4 are used for dimming. In one or more embodiments, the lengths of vertical sync periods #3 and #4 are equal to each other, longer than the length of vertical sync periods #1 and #2, and shorter than the length of vertical sync periods #5 and #6. In one or more embodiments, the length of vertical sync periods #1 and #2 is four times of the length of the control cycles, and the length of vertical sync periods #5 and #6 and their following vertical sync periods is six times of the length of the control cycles. In such embodiments, the length of vertical sync periods #3 and #4 is set to five times of the length of the control cycles. In one or more embodiments, the use of multiple vertical sync periods for the dimming further reduces the change rate of the display brightness level, further suppressing occurrence of flicker.

In one or more embodiments, as illustrated in FIG. 9, the vertical sync period length is gradually extended over multiple vertical sync periods used for dimming. In one or more embodiments, the frame rate is set to 90 Hz during vertical sync periods #1 and #2 and 45 Hz during vertical sync periods #6, #7 and the following vertical sync periods. In one or more embodiments, the length of vertical sync periods #1 and #2 is four times of the length of the control cycles, and the length of vertical sync periods #6, #7 and the following vertical sync periods is eight times of the length of the control cycles. In one or more embodiments, the vertical sync period length is gradually extended over vertical sync periods #3 to #5, which are used for dimming. In one or more embodiments, the lengths of vertical sync periods #3, #4, and #5 are set to five times, six times, and seven times of the length of the control cycles, respectively. In one or more embodiments, this operation further reduces the change rate of the display brightness level, further suppressing occurrence of flicker.

Figure 10:
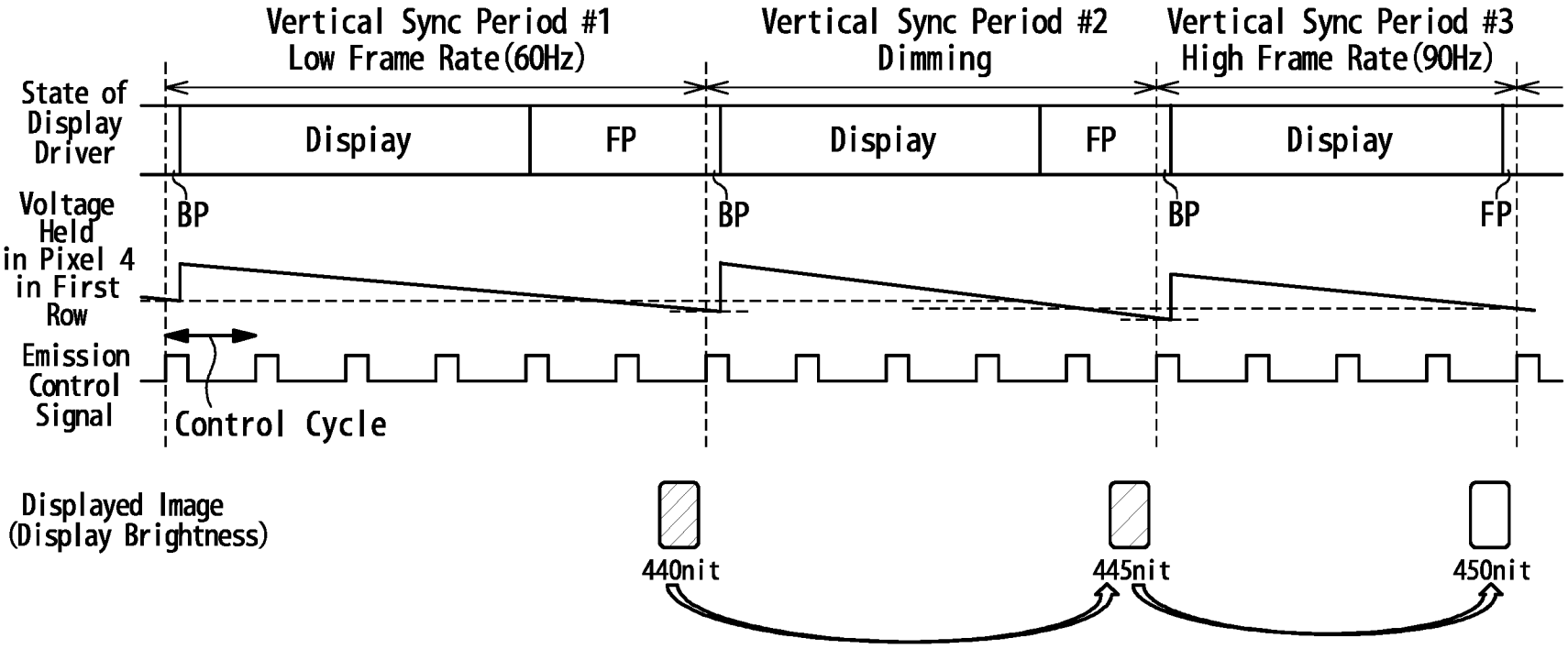
FIG. 10 is a timing chart illustrating an example operation of a display device, according to one or more embodiments.

In one or more embodiments, as illustrated in FIG. 10, the vertical sync period length is changed and reduced to switch the frame rate. In one or more embodiments, the reduction in the vertical sync period length is achieved by the timing generator 16 advancing the timing at which the internal vertical sync signal VSYNC is asserted. In one or more embodiments, the frame rate during vertical sync period #1 is a first frame rate, the frame rate during vertical sync period #3 and following vertical sync periods is set to a second frame rate higher than the first frame rate by setting the length of vertical sync period #3 and the following vertical sync periods to be shorter than the length of vertical sync period #1. In one or more embodiments, the frame rate is switched from the first frame rate to the second frame rate by shortening the front porch periods of vertical sync period #3 and the following vertical sync periods. In one or more embodiments, the increase in the frame rate through the reduction in the vertical sync period length is performed after the decrease in the frame rate through the increase in the vertical sync period length as illustrated in FIGS. 7 to 10.

In one or more embodiments, the switching of the frame rate through the reduction in the vertical sync period length may be accompanied by a change in the display brightness level, similarly to the case where the vertical sync period length is extended. To reduce the change rate of the display brightness level, in one or more embodiments, dimming is performed in switching the frame rate and the vertical sync period length is gradually shortened.

In one or more embodiments, vertical sync period #2, disposed between vertical sync periods #1 and #3, is used for dimming of the display brightness level; the length of vertical sync period #2 is set to be shorter than the length of vertical sync period #1 and longer than the length of vertical sync period #3. In such embodiments, the display brightness level during vertical sync period #2 becomes between the display brightness levels during vertical sync periods #1 and 3, and this reduces the change rate of the display brightness level. In one or more embodiments, the reduction in the change rate of the display brightness level effectively suppresses occurrence of flicker.

In one or more embodiments, the timing of the initiation of vertical sync period #3 is synchronized with the timing of the completion of the final control cycle of vertical sync period #2, and the timing of the initiation of the vertical sync period following vertical sync period #3 is synchronized with the timing of the completion of the final control cycle of vertical sync period #3. In the operation illustrated in FIG. 10, the timing of the initiation of vertical sync period #3 is made coincident with the timing of the completion of the final control cycle of vertical sync period #2 is completed, and the timing of the initiation of the vertical sync period following vertical sync period #3 is made coincident with the timing of the completion of the final control cycle of vertical sync period #3. In one or more embodiments, this operation improves the image brightness control and suppresses or prevents occurrence of flicker or undesired changes in the brightness level.

In one or more embodiments, such synchronization or coincidence is achieved by setting the lengths of vertical sync periods #1 to #3 to integer multiples of the length of the control cycles. In one or more embodiments, the frame rate is 60 Hz during vertical sync period #1 and 90 Hz during vertical sync period #3 and the following vertical sync periods. In one or more embodiments, the length of vertical sync period #1 is six times of the length of the control cycles, the length of vertical sync period #3 and the following vertical sync periods is four times of the length of the control cycles, and the length of vertical sync period #2 is five times of the length of the control cycles.

Figure 11:
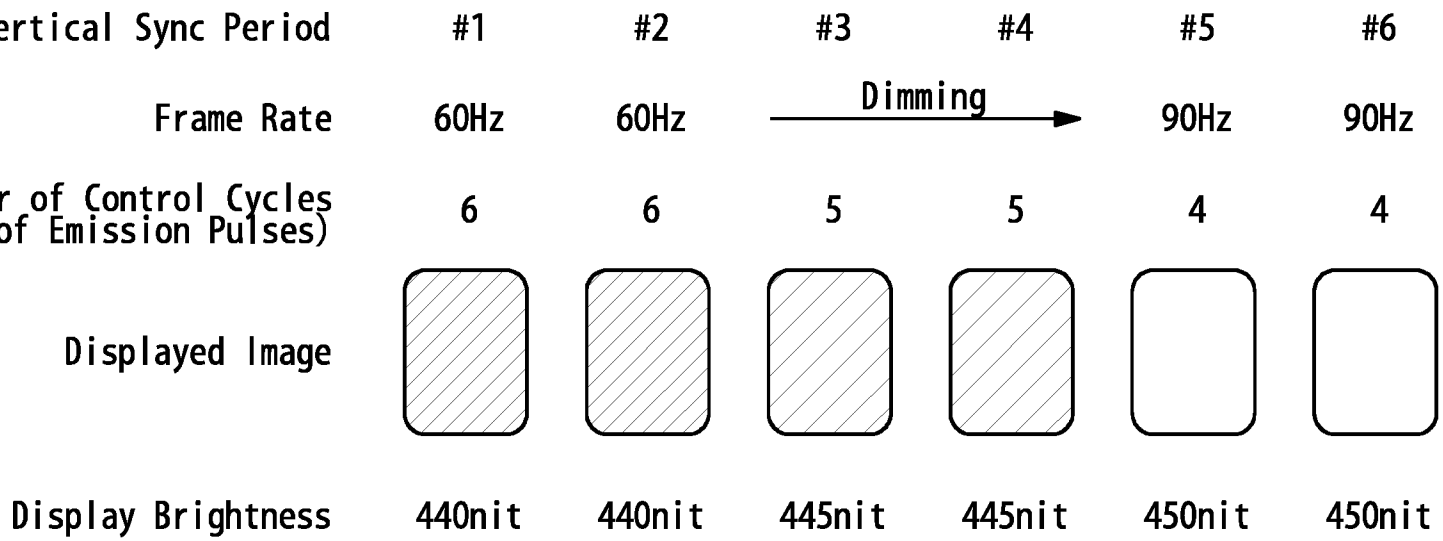
FIG. 11 illustrates an example operation of a display device, according to one or more embodiments.
Figure 12:
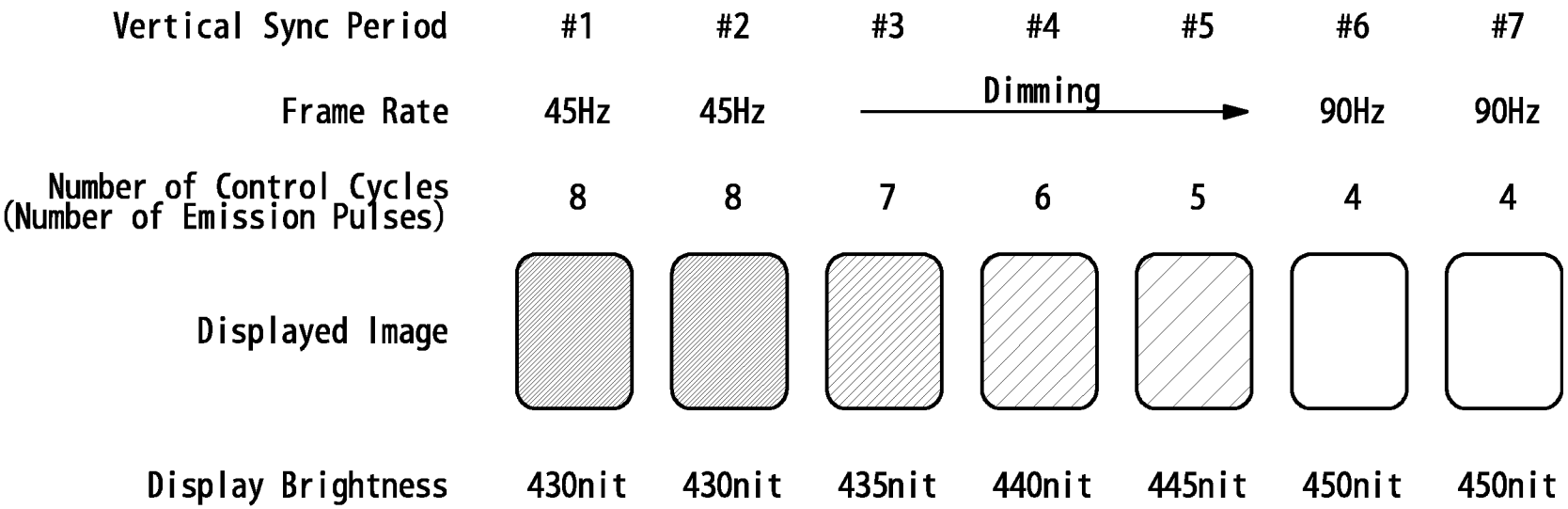
FIG. 12 illustrates an example operation of a display device, according to one or more embodiments.

In one or more embodiments, as illustrated in FIGS. 11 and 12, multiple vertical sync periods are used for dimming in switching the frame rate. In one or more embodiments, as illustrated in FIG. 11, the frame rate is set to 60 Hz during vertical sync periods #1 and #2 and 90 Hz during vertical sync periods #5, #6 and the following vertical sync periods. In one or more embodiments, vertical sync periods #3 and #4 are used for dimming. In one or more embodiments, the lengths of vertical sync periods #3 and #4 are equal to each other, longer than the length of vertical sync periods #1 and #2, and shorter than the length of vertical sync periods #5 and #6. In one or more embodiments, the length of vertical sync periods #1 and #2 is four times of the length of the control cycles, and the length of vertical sync periods #5, #6 and the following vertical sync periods is six times of the length of the control cycles. In such embodiments, the length of vertical sync periods #3 and #4 is set to five times of the length of the control cycles. In one or more embodiments, the use of multiple vertical sync periods for the dimming further reduces the change rate of the display brightness level, further suppressing occurrence of flicker.

In one or more embodiments, as illustrated in FIG. 12, the vertical sync period length is gradually shortened over multiple vertical sync periods used for the dimming. In one or more embodiments, the frame rate is set to 45 Hz during vertical sync periods #1 and #2 and 90 Hz during vertical sync periods #6, #7 and following vertical sync periods. In one or more embodiments, the length of vertical sync periods #1 and #2 is eight times of the length of control cycles, and the length of vertical sync periods #6, #7 and the following vertical sync periods is four times of the length of control cycles. In one or more embodiments, the vertical sync period length is gradually extended over vertical sync periods #3 to #5, which are used for dimming. In one or more embodiments, the lengths of vertical sync periods #3, #4, and #5 are set to seven times, six times, and five times of the length of the control cycles, respectively. In one or more embodiments, this operation further reduces the change rate of the display brightness level, further suppressing occurrence of flicker.

Although various embodiments of this disclosure have been specifically described, the person skilled in the art would appreciate that the technologies disclosed herein may be implemented with various modifications.

What is claimed is:

1. A semiconductor device, comprising:

circuitry configured to generate an emission control signal that controls light emission of pixels of a display panel such that a first vertical sync period comprises a plurality of control cycles for the light emission of the pixels; and a timing generator configured to, when a length of the first vertical sync period is changed, start a next vertical sync period following the first vertical sync period at a timing based on a length of the control cycles.

2. The semiconductor device according to claim 1, wherein the timing generator is further configured to, when the length of the first vertical sync period is extended, start the next vertical sync period in synchronization with a completion of a final control cycle of the first vertical sync period.

3. The semiconductor device according to claim 1, wherein the timing generator is further configured to, when the length of the first vertical sync period is extended, start the next vertical sync period to set the length of the first vertical sync period to be an integer multiple of the length of the control cycles.

4. The semiconductor device according to claim 1, further comprising a data interface configured to communicate with a host, wherein the timing generator is further configured to control the data interface to transmit an image data transmission request to the host in the first vertical sync period and extend the first vertical sync period when the data interface does not start receiving image data within a predetermined time after the transmission of the image data transmission request.

5. The semiconductor device according to claim 4, wherein the image data corresponds to an image to be displayed in the next vertical sync period.

6. The semiconductor device according to claim 5, wherein the first vertical sync period is extended when the host does not complete generation of the image data until the predetermined time has elapsed after the transmission of the image data transmission request to the host.

7. The semiconductor device according to claim 4, wherein the timing generator is configured to extend a front porch period of the first vertical sync period when the data interface does not start receiving the image data within the predetermined time after the transmission of the image data transmission request.

8. The semiconductor device according to claim 1, wherein a frame rate of a second vertical sync period before the first vertical sync period is a first frame rate, wherein a frame rate of a third vertical sync period following the first vertical sync period is a second frame rate lower than the first frame rate, and wherein the length of the first vertical sync period is longer than a length of the second vertical sync period and shorter than a length of the third vertical sync period.

9. The semiconductor device according to claim 8, wherein a length of a fourth vertical sync period between the first vertical sync period and the third vertical sync period is equal to the length of the first vertical sync period.

10. The semiconductor device according to claim 8, wherein a length of a fourth vertical sync period between the first vertical sync period and the third vertical sync period is longer than the length of the first vertical sync period and shorter than the length of the third vertical sync period.

11. The semiconductor device according to claim 10, wherein the lengths of the first vertical sync period, the second vertical sync period, the third vertical sync period, and the fourth vertical sync period are integer multiples of the length of the control cycles.

12. The semiconductor device according to claim 8, wherein the lengths of the first vertical sync period, the second vertical sync period, and the third vertical sync period are integer multiples of the length of the control cycles.

13. The semiconductor device according to claim 1, wherein a frame rate of a second vertical sync period before the first vertical sync period is a first frame rate, wherein a frame rate of a third vertical sync period following the first vertical sync period is a second frame rate higher than the first frame rate, and wherein the length of the first vertical sync period is shorter than a length of the second vertical sync period and longer than a length of the third vertical sync period.

14. The semiconductor device according to claim 1, further comprising driver circuitry configured to drive the pixels of the display panel based on image data.

15. A semiconductor device, comprising:

circuitry configured to generate an emission control signal that controls light emission of pixels of a display panel such that a first vertical sync period of a plurality of vertical sync periods comprises a plurality of control cycles for the light emission of the pixels;

a data interface configured to transmit an image data transmission request to a host in the first vertical sync period; and a timing generator configured to generate a vertical sync signal defining the plurality of vertical sync periods and, when the data interface does not start receiving image data within a predetermined period after the transmission of the image data transmission request, delay timing at which the vertical sync signal is next asserted, based on a length of the control cycles.

16. The semiconductor device according to claim 15, wherein the timing generator is further configured to, when the data interface does not start receiving image data within the predetermined period after the transmission of the image data transmission request, control the timing at which the vertical sync signal is next asserted in synchronization with a completion of a final control cycle of the first vertical sync period.

17. A display panel driving method, comprising:

supplying to a display panel an emission control signal controlling light emission of pixels of the display panel to dispose a plurality of control cycles of the light emission of the pixels in a first vertical sync period; and when a length of the first vertical sync period is changed, starting a next vertical sync period following the first vertical sync period at timing based on a length of the control cycles.

18. The display panel driving method according to claim 17, wherein starting the next vertical sync period comprises:

when the length of the first vertical sync period is extended, starting the next vertical sync period in synchronization with a completion of a final control cycle of the first vertical sync period.

19. The display panel driving method according to claim 17, wherein starting the next vertical sync period comprises:

when the length of the first vertical sync period is extended, starting the next vertical sync period so that the length of the first vertical sync period is an integer multiple of the length of the control cycles.

20. The display panel driving method according to claim 17, further comprising:

transmitting an image data transmission request from a display driver to a host in the first vertical sync period, wherein starting the next vertical sync period comprises:

extending the first vertical sync period when the display driver does not start receiving image data within a predetermined time after the transmission of the image data transmission request.

21. The display panel driving method according to claim 17, further comprising:

generating a vertical sync signal defining the first vertical sync period; and transmitting an image data transmission request from a display driver to a host in the first vertical sync period, wherein starting the next vertical sync period comprises when the display driver does not start receiving image data within a predetermined time after the transmission of the image data transmission request, delaying timing at which the vertical sync signal is next asserted based on the length of the control cycles.

22. The display panel driving method according to claim 17, wherein a frame rate of a second vertical sync period before the first vertical sync period is a first frame rate, wherein a frame rate of a third vertical sync period following the first vertical sync period is a second frame rate lower than the first frame rate, wherein the length of the first vertical sync period is longer than a length of the second vertical sync period and shorter than a length of the third vertical sync period.

23. The display panel driving method according to claim 22, wherein the lengths of the first vertical sync period, the second vertical sync period, and the third vertical sync period are integer multiples of the length of the control cycles.

* * * * *